US012467444B1

(12) United States Patent
Zhu

(10) Patent No.: US 12,467,444 B1
(45) Date of Patent: Nov. 11, 2025

(54) FULL-SEALING POSITIVE PRESSURE AND NEGATIVE PRESSURE INTEGRATED OIL-FREE COMPRESSOR FOR OXYGEN GENERATION

(71) Applicant: SHENYANG CANTA MEDICAL TECH. CO., LTD., Shenyang (CN)

(72) Inventor: Xiaobo Zhu, Shenyang (CN)

(73) Assignee: SHENYANG CANTA MEDICAL TECH. CO., LTD., Shenyang (CN)

( * ) Notice: Subject to any disclaimer, the term of this patent is extended or adjusted under 35 U.S.C. 154(b) by 0 days.

(21) Appl. No.: 19/018,992

(22) Filed: Jan. 13, 2025

Related U.S. Application Data

(63) Continuation of application No. PCT/CN2024/120965, filed on Sep. 25, 2024.

(30) Foreign Application Priority Data

Jun. 20, 2024 (CN) ..... 202410796493.8

(51) Int. Cl.
*F04B 39/04* (2006.01)
*F04B 27/00* (2006.01)
(Continued)

(52) U.S. Cl.
CPC ..... *F04B 39/041* (2013.01); *F04B 27/005* (2013.01); *F04B 39/12* (2013.01); *F04B 49/125* (2013.01)

(58) Field of Classification Search
CPC ..... F04B 39/041; F04B 27/005; F04B 39/12; F04B 49/125; F04B 27/053; F04B 1/0421;
(Continued)

(56) References Cited

U.S. PATENT DOCUMENTS 2,255,851 A * 9/1941 Lundin ..... F04B 1/053 91/474
2,673,028 A * 3/1954 Cornelius ..... F04B 39/02 417/265
(Continued)

FOREIGN PATENT DOCUMENTS

CN 116498519 A 7/2023
CN 219827078 U 10/2023
(Continued)

OTHER PUBLICATIONS

First Office Action in Corresponding Chinese Application No. 202410796493.8, dated Jul. 23, 2024; 22 pgs.
(Continued)

*Primary Examiner* — Mark A Laurenzi
*Assistant Examiner* — Benjamin Doyle
(74) *Attorney, Agent, or Firm* — HAUPTMAN HAM, LLP

(57) ABSTRACT

A full-sealing positive pressure and negative pressure integrated oil-free compressor for oxygen generation includes a motor, a vacuum air passage structure, a supporting body, a positive pressure air passage structure and air cylinders, wherein the vacuum air passage structure, the supporting body and the positive pressure air passage structure are fixedly mounted on an upper surface of the motor in sequence, and no air passage is arranged on a surface of the supporting body. According to the present disclosure, the whole structure is compact and can be stably mounted on a motor body, using demands for miniaturization and compactness of the compressor are met, the structure of the supporting body is also adjusted, no air passage is arranged on the surface of the supporting body, the number of sealing structures needing to be arranged is reduced, the reliability
(Continued)

is improved, machining is simpler, and technical assembling difficulty is lowered significantly.

8 Claims, 13 Drawing Sheets

(51) Int. Cl.
*F04B 39/12* (2006.01)
*F04B 49/12* (2006.01)

(58) Field of Classification Search
CPC .... F04B 27/02; F04B 27/0414; F04B 39/121; F04B 39/122
USPC ..... 417/521, 271, 273
See application file for complete search history.

(56) References Cited

U.S. PATENT DOCUMENTS 4,190,402 A * 2/1980 Meece ..... F04B 35/04 92/155
5,515,769 A * 5/1996 Basinski ..... F04B 39/04 92/169.1
5,584,675 A * 12/1996 Steurer ..... F04B 39/066 417/372
6,589,024 B2 * 7/2003 Nishikawa ..... F04B 25/00 417/273
6,776,587 B2 * 8/2004 Meyer ..... F04B 25/00 417/248
10,253,630 B2 * 4/2019 Shimazu ..... F04B 1/0531
2001/0036410 A1 * 11/2001 DeRuyter ..... F04B 27/02 417/366
2004/0131489 A1 * 7/2004 Leu ..... F04B 39/0094 417/569
2005/0201880 A1 * 9/2005 Gentilin ..... F04B 25/00 417/415
2009/0016917 A1 * 1/2009 Smits ..... F01B 7/04 92/147
2010/0319547 A1 * 12/2010 Kondou ..... F04B 27/0414 417/273
2012/0177524 A1 * 7/2012 Komatsu ..... F04B 9/045 418/161
2014/0216262 A1 * 8/2014 Kondou ..... F04B 27/053 417/271
2014/0227115 A1 * 8/2014 Ranker ..... F04B 39/12 417/321
2018/0291885 A1 * 10/2018 Grybush ..... F04B 27/0538
2020/0208619 A1 * 7/2020 Komatsu ..... F04B 27/02
2024/0060483 A1 * 2/2024 Wu ..... F04B 39/121

FOREIGN PATENT DOCUMENTS

CN 220791428 U * 4/2024 ..... F04B 35/04
CN 118361373 A 7/2024

OTHER PUBLICATIONS

First Search Report in Corresponding Chinese Application No. 202410796493.8, dated Jul. 19, 2024; 6 pgs.
International Search Report and Written Opinion in Corresponding International Application No. PCT/CN2024/120965, mailed Dec. 10, 2024; 13 pgs.

* cited by examiner

FULL-SEALING POSITIVE PRESSURE AND NEGATIVE PRESSURE INTEGRATED OIL-FREE COMPRESSOR FOR OXYGEN GENERATION

RELATED APPLICATIONS

The present application is a Continuation of International Application No. PCT/CN2024/120965, filed Sep. 25, 2024, which claims priority from Chinese Patent Application No. 202410796493.8, filed Jun. 20, 2024, the disclosures of which are hereby incorporated by reference herein in their entireties.

TECHNICAL FIELD

The present disclosure belongs to the technical field of compressors and particularly provides a full-sealing positive pressure and negative pressure integrated oil-free compressor for oxygen generation.

BACKGROUND OF THE INVENTION

In an oxygen generation device, an oil-free compressor is a key component. The compressor for oxygen generation generates compressed gas usually by cooperation of an air cylinder and a piston and then completes injecting high pressure oxygen into an oxygen storage tank, the air cylinder is usually mounted on a supporting body, an air passage needs to be arranged on the supporting body to be connected with the air cylinder and outside space, self strength of the supporting body will be reduced, a plurality of space hole positions need to be arranged for sealing connection, reliability is low, and meanwhile, a fault rate of sealing aging, air leakage and the like is high. Besides, for the same type of compressor for the oxygen generation device on the market, a motor and a compressor structure are in an open state, these open hole positions will suck or bring unclean air in an environment into an oxygen generation link during running, purity of oxygen is affected, it cannot be applied to a plateau wind-blown sand region, workpieces inside the compressor will get stuck due to influence of dust and sand grains, and finally, a service life of the compressor is affected.

SUMMARY OF THE INVENTION

For solving the above problem, the present disclosure provides a full-sealing positive pressure and negative pressure integrated oil-free compressor for oxygen generation.

For achieving the above objective, a technical solution adopted by the present disclosure is: a full-sealing positive pressure and negative pressure integrated oil-free compressor for oxygen generation includes a motor, a vacuum air passage structure, a supporting body, a positive pressure air passage structure and an air cylinder, wherein the vacuum air passage structure, the supporting body and the positive pressure air passage structure are fixedly mounted on an upper surface of the motor in sequence, the positive pressure air passage structure does not communicate with the supporting body, no air passage is arranged on a surface of the supporting body, the air cylinder includes two negative pressure vacuum air cylinders and two positive pressure compression air cylinders, the negative pressure vacuum air cylinders and the positive pressure compression air cylinders are fixedly mounted on four side surfaces of the supporting body in an alternating mode, the two negative pressure vacuum air cylinders communicate with the vacuum air passage structure, the two positive pressure compression air cylinders communicate with the positive pressure air passage structure, an eccentric wheel group is assembled on an output shaft of the motor, piston rods are assembled on an outer surface of the eccentric wheel group, the four piston rods are assembled in the corresponding air cylinders respectively, leather cup pressing plates are fixedly mounted on outer end faces of the piston rods, and leather cups are assembled at outer ends of the piston rods through the leather cup pressing plates;

the vacuum air passage structure includes a vacuum air passage supporting body, vacuum air passage valve chambers are symmetrically formed in an upper surface of the vacuum air passage supporting body, negative pressure suction and exhaust passages and negative pressure vacuum air cylinder connecting air passages which communicate with the vacuum air passage valve chambers are formed in side surfaces of the vacuum air passage supporting body, the two negative pressure suction and exhaust passages are located in the symmetrical side surfaces of the vacuum air passage supporting body, the four negative pressure vacuum air cylinder connecting air passages are uniformly located in the other side surfaces of the vacuum air passage supporting body, the negative pressure suction and exhaust passages are connected with pipe joints, and the negative pressure vacuum air cylinder connecting air passages communicate with the air cylinders;

the positive pressure air passage structure includes a positive pressure air passage supporting body, positive pressure air passage valve chambers are symmetrically formed in an upper surface of the positive pressure air passage supporting body, positive pressure compression exhaust passages and positive pressure compression air cylinder connecting air passages which communicate with the positive pressure air passage valve chambers are formed in side surfaces of the positive pressure air passage supporting body, the two positive pressure compression exhaust passages are located in the symmetrical side surfaces of the positive pressure air passage supporting body, the four positive pressure compression air cylinder connecting air passages are uniformly located in the other side surfaces of the positive pressure air passage supporting body, the positive pressure compression exhaust passages are connected with pipe joints, and the positive pressure compression air cylinder connecting air passages communicate with the air cylinders.

Further each air cylinder includes an air cylinder main body and an air cylinder valve chamber cover, wherein the air cylinder valve chamber cover is assembled on an outer surface of the air cylinder main body, the air cylinder main body is fixedly mounted on the supporting body, air cylinder valve chambers which are arranged symmetrically are formed in the outer surface of the air cylinder main body, air exchange holes which communicate with the air cylinder valve chambers are formed in a surface of the air cylinder main body, the air exchange holes correspond to the negative pressure vacuum air cylinder connecting air passages or the positive pressure compression air cylinder connecting air passages, a compression cavity is formed in an inner surface of the air cylinder main body, the piston rod is movably assembled in the compression cavity, vent holes are formed in an inner surface of the compression cavity, and the plurality of vent holes are located in the two air cylinder valve chambers respectively.

Further, each air cylinder further includes a negative pressure valve sheet, a negative pressure valve sheet pressing plate, a positive pressure valve sheet and a positive pressure valve sheet pressing plate, wherein the negative pressure valve sheet is fixedly mounted on an inner surface of the air cylinder valve chamber through the negative pressure valve sheet pressing plate, the positive pressure valve sheet is fixedly mounted on the inner surface of the compression cavity through the positive pressure valve sheet pressing plate, the negative pressure valve sheet and the positive pressure valve sheet block the vent holes in the different air cylinder valve chambers, a shape of the negative pressure valve sheet pressing plate is the same as a shape of the negative pressure valve sheet, and an outer end of the negative pressure valve sheet pressing plate is lifted in an arc towards an outer side.

Further, an air cylinder seal ring mounting groove is formed in an outer surface of the air cylinder main body, and an air cylinder seal ring is assembled in the air cylinder seal ring mounting groove.

Further, the air cylinder main body and the leather cups are made of a polytetrafluoroethylene material, and a self-lubricating coating is arranged on an inner wall of the compression cavity of the air cylinder main body.

Further, a net-shaped heat dissipation structure is arranged on an outer surface of each air cylinder valve chamber cover.

Further, the leather cups include a positive pressure end leather cup and a vacuum end leather cup, an opening of the positive pressure end leather cup faces an outer side, and an opening of the vacuum end leather cup faces an inner side.

Further, inclination angle supplement structures are arranged on the outer end faces of the piston rods and outer end faces of the leather cup pressing plates.

Further, sealing element mounting grooves are formed in the upper surface of the vacuum air passage supporting body and the upper surface of the positive pressure air passage supporting body, planar sealing elements are assembled in the sealing element mounting grooves, and a top cover is fixedly mounted on the upper surface of the positive pressure air passage supporting body.

Further, the eccentric wheel group is formed by combining two eccentric wheels which are integrally formed, deflection angles of the two eccentric wheels relative to the output shaft of the motor are different, and two piston rods are symmetrically assembled on an outer wall of each eccentric wheel.

Beneficial effects by using the present disclosure are the following.

1. The present disclosure designs a structure of the vacuum air passage structure, the supporting body and the positive pressure air passage structure in cooperation, the whole structure is compact and can be stably mounted on a motor body through the assembly cooperation of the vacuum air passage structure, the supporting body and the positive pressure air passage structure, and using demands for miniaturization and compactness of the compressor can be met.

2. The present disclosure also adjusts a structure of the supporting body, no air passage is arranged on the surface of the supporting body, thus the number of sealing structures needing to be arranged due to an air passage on a supporting body of an existing compressor is reduced, the whole compressor is in a full-sealing structure design without exposure holes, matters such as dust are effectively prevented from entering the compressor, occurrence of faults of sealing aging, air leakage and the like are reduced, due to omission of the air passage on the supporting body, the supporting body has a higher self strength and can play a better role in supporting and positioning, reliability is improved, machining is simpler, and technical assembling difficulty is lowered significantly.

3. By designing structures and assembly of the vacuum air passage structure, the positive pressure air passage structure and the air cylinders, two modes of positive pressure compression and negative pressure vacuumizing can be formed on a machine body, and due to the design of the air passages on the vacuum air passage structure and the positive pressure air passage structure without an air passage on the supporting body, distribution of an air way and a form of convergence are simpler and more reliable than the existing compressor.

4. The present disclosure designs the piston rods, angle compensation is performed by arranging the inclination angle supplement structures, so the outer end faces of the piston rods and the leather cup pressing plates are all inclined, the piston rods are made to remain a rectangular compression state with inner surfaces of the air cylinders to the maximum degree during a stroke process, thus a compression ratio is ensured, effective compression is achieved, and wear of the leather cups is reduced.

5. The present disclosure arranges a cross-shaped piston group which can work alternately in the four air cylinders so that the compressor may complete sufficient a compressed air volume through a smaller stroke, the piston rods and the stroke of this structure are shorter, dispersed heat and vibration can be effectively reduced, and thus energy consumption of the compressor is reduced.

Figure 1:
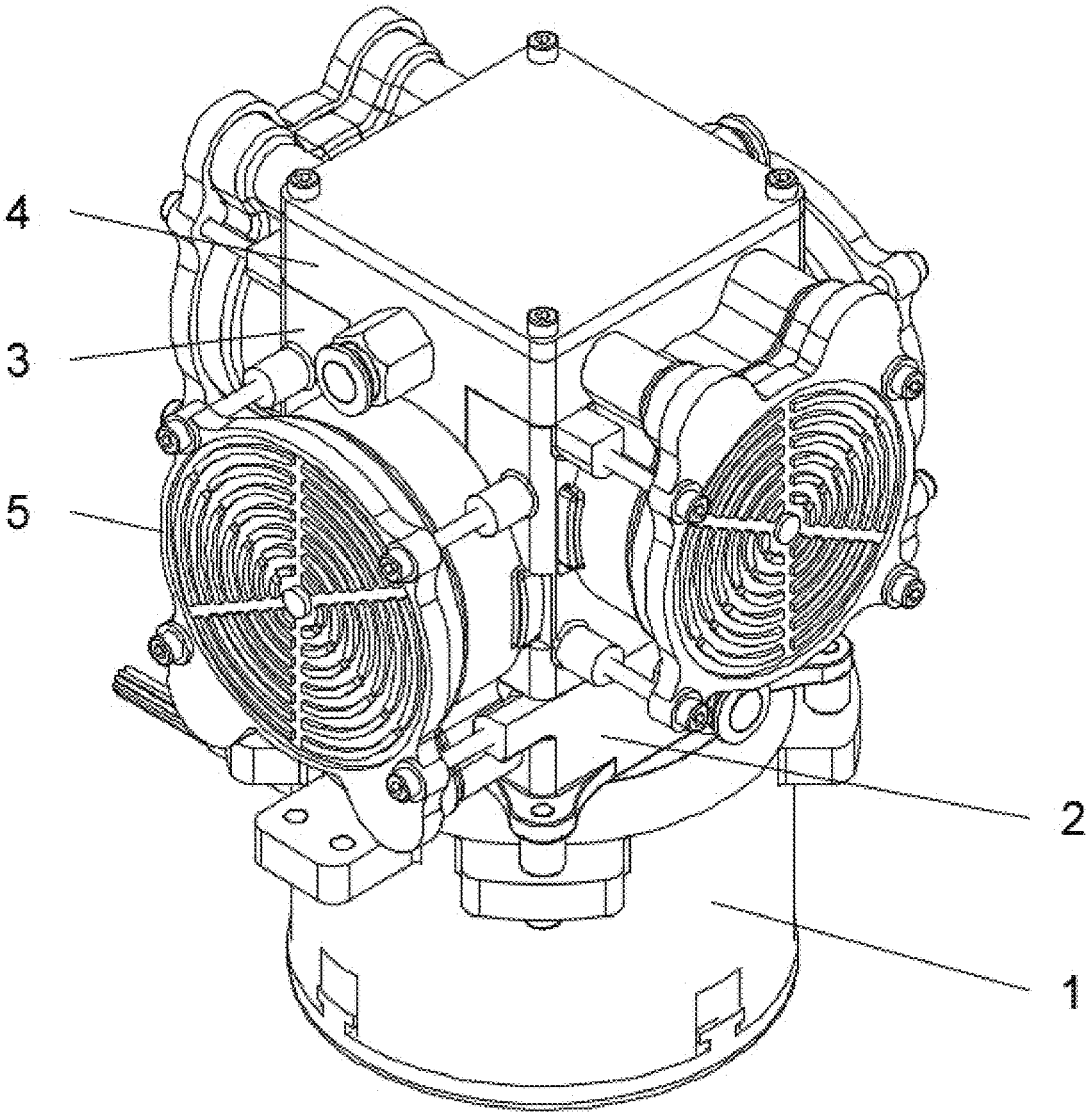
FIG. 1 is a first space diagram of the present disclosure.

Reference numerals in the accompanying drawings include: 1, motor, 2, vacuum air passage structure, 21, vacuum air passage supporting body, 22, vacuum air passage valve chamber, 23, negative pressure suction and exhaust passage, 24, negative pressure vacuum air cylinder connecting air passage, 3, supporting body, 4, positive pressure air passage structure, 41, positive pressure air passage supporting body, 42, positive pressure air passage valve chamber, 43, positive pressure compression exhaust passage, 44, positive pressure compression air cylinder connecting air passage, 5, air cylinder, 51, air cylinder main body, 52, air cylinder valve chamber, 53, air exchange hole, 54, negative pressure valve sheet, 55, negative pressure valve sheet pressing plate, 56, positive pressure valve sheet, 57, positive pressure valve sheet pressing plate, 58, air cylinder seal ring, 59, air cylinder valve chamber cover, 6, eccentric wheel group, 7, piston rod, 8, positive pressure end leather cup, and 9, vacuum end leather cup.

DETAILED DESCRIPTION OF THE INVENTION

The technical solutions in embodiments of the present disclosure are clearly and completely described in the following with reference to the accompanying drawings in the embodiments of the present disclosure. Apparently, the described embodiments are merely some rather than all of the embodiments of the present disclosure. All other embodiments obtained by those ordinarily skilled in the art based on the embodiments of the present disclosure without making creative efforts fall within the protection scope of the present disclosure.

Referring to FIG. 1 to FIG. 17, a full-sealing positive pressure and negative pressure integrated oil-free compressor for oxygen generation includes a motor 1, a vacuum air passage structure 2, a supporting body 3, a positive pressure air passage structure 4 and air cylinders 5, wherein the vacuum air passage structure 2, the supporting body 3 and the positive pressure air passage structure 4 are fixedly mounted on an upper surface of the motor 1 in sequence, the positive pressure air passage structure 4 does not communicate with the supporting body 3, no air passage is arranged on a surface of the supporting body 3, the air cylinders 5 include two negative pressure vacuum air cylinders and two positive pressure compression air cylinders, the negative pressure vacuum air cylinders and the positive pressure compression air cylinders are fixedly mounted on four side surfaces of the supporting body 3 in an alternating mode, the two negative pressure vacuum air cylinders communicate with the vacuum air passage structure 2, the two positive pressure compression air cylinders communicate with the positive pressure air passage structure 4, an eccentric wheel group 6 is assembled on an output shaft of the motor 1, piston rods 7 are assembled on an outer surface of the eccentric wheel group 6, the four piston rods 7 are assembled in the corresponding air cylinders 5 respectively, leather cup pressing plates are fixedly mounted on outer end faces of the piston rods 7, and leather cups are assembled at outer ends of the piston rods 7 through the leather cup pressing plates.

The motor 1 provides power to drive the eccentric wheel group 6 to rotate, so as to cause the piston rods 7 to perform a reciprocating motion in the corresponding air cylinders 5 for performing works of sucking air and compressing air.

Reserved assembling lugs are assembled on an upper side of an outer surface of a shell of the motor 1, the vacuum air passage structure 2 is mounted on some reserved assembling lugs, and the other reserved assembling lugs are configured to mount and fix the motor 1.

No air passage is arranged on the surface of the supporting body 3, so a sealing structure needing to be arranged on the supporting body 3 is omitted, occurrence of faults of sealing aging and the lime is reduced, the whole compressor is of a full-sealing structure without exposure holes, unique air exchange openings (joints connecting the negative pressure suction and exhaust passages 23 and the positive pressure compression exhaust passages 43) of the compressor is achieved through structure cooperation, matters such as dust can be effectively prevented from entering the compressor, loss of a dynamic sealing component in the compressor is reduced, safety of the compressor is improved, and a service life of the compressor is prolonged.

No air passage is arranged on the supporting body 3, so the supporting body has an increased strength, can play a better role in supporting and positioning, and makes machining simpler and technical assembling easier.

As the vacuum air passage structure 2, the positive pressure air passage structure 4 and the four air cylinders 5 are fixedly mounted on six surfaces of the supporting body 3 respectively, the whole structure of this part is compact and can be stably mounted on the motor 1, the motor 1 is effectively supported, and using demands for minimization and compactness of the compressor can be met.

The two negative pressure vacuum air cylinders are symmetrically distributed on the supporting body 3, the two positive pressure compression air cylinders are symmetrically distributed on the supporting body 3, and a total of four air cylinders 5 are distributed in a cross shape.

The eccentric wheel group 6 and the piston rods 7 form a cross-shaped piston group.

As shown in FIG. 4 to FIG. 8, the vacuum air passage structure 2 includes a vacuum air passage supporting body 21, vacuum air passage valve chambers 22 are symmetrically formed in an upper surface of the vacuum air passage supporting body 21, negative pressure suction and exhaust passages 23 and negative pressure vacuum air cylinder connecting air passages 24 which communicate with the vacuum air passage valve chambers 22 are formed in side surfaces of the vacuum air passage supporting body 21, the two negative pressure suction and exhaust passages 23 are located in the symmetrical side surfaces of the vacuum air passage supporting body 21, the four negative pressure vacuum air cylinder connecting air passages 24 are uniformly located in the other side surfaces of the vacuum air passage supporting body 21, the negative pressure suction and exhaust passages 23 are connected with pipe joints, and the negative pressure vacuum air cylinder connecting air passages 24 communicate with the air cylinders 5.

Joints are connected with the negative pressure suction and exhaust passages 23 and are air entering joints and exhaust joints respectively for sucking and discharging air.

An air circulation direction of air exchange of the vacuum air passage structure 2 is: air is sucked through the air entering joints and the negative pressure suction and exhaust passages 23 and flows into a negative pressure vacuum air cylinder via the vacuum air passage valve chamber 22 and the negative pressure vacuum air cylinder connecting air passage 24 on the same side, so as to complete an air entering work, and at the moment, another negative pressure vacuum air cylinder may perform an air compression work, and compressed air is discharged from the negative pressure suction and exhaust passage 23 and the exhaust joint on the other side via the negative pressure vacuum air cylinder connecting air passage 24 and the vacuum air passage valve chamber 22 on the other side.

As the two negative pressure vacuum air cylinders are symmetrically distributed on the supporting body 3, the vacuum air passage valve chambers 22 communicating with the air entering joints are air entering valve chambers all the time, and the vacuum air passage valve chambers 22 communicating with the exhaust joints are exhaust valve chambers all the time.

Figure 9:
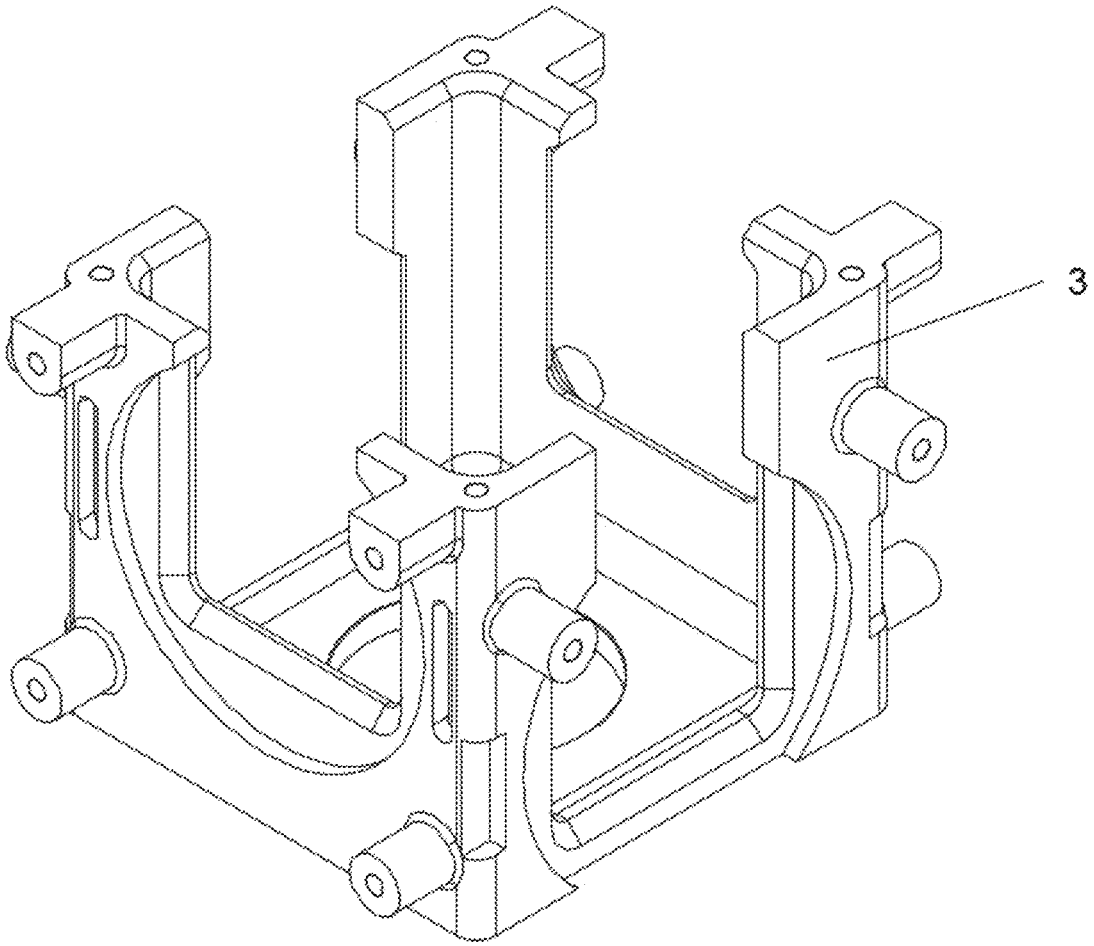
FIG. 9 is a space diagram of a positive pressure air passage structure and air cylinders in cooperation in the present disclosure.
Figure 10:
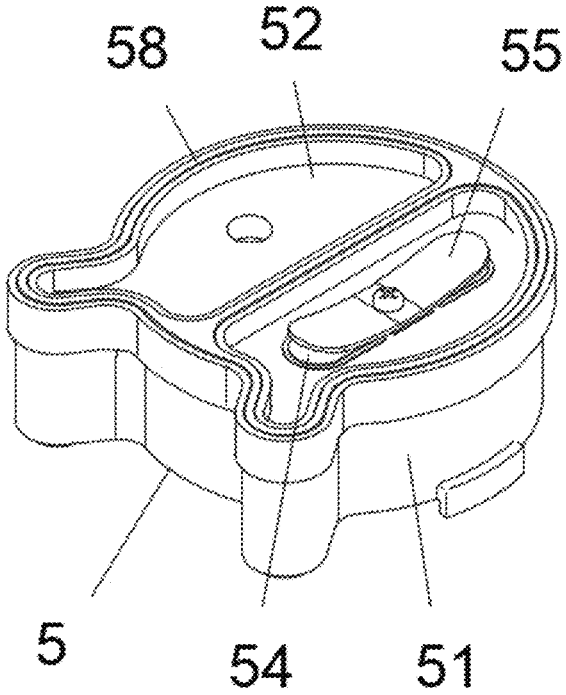
FIG. 10 is a space diagram of a positive pressure air passage structure of the present disclosure.
Figure 11:
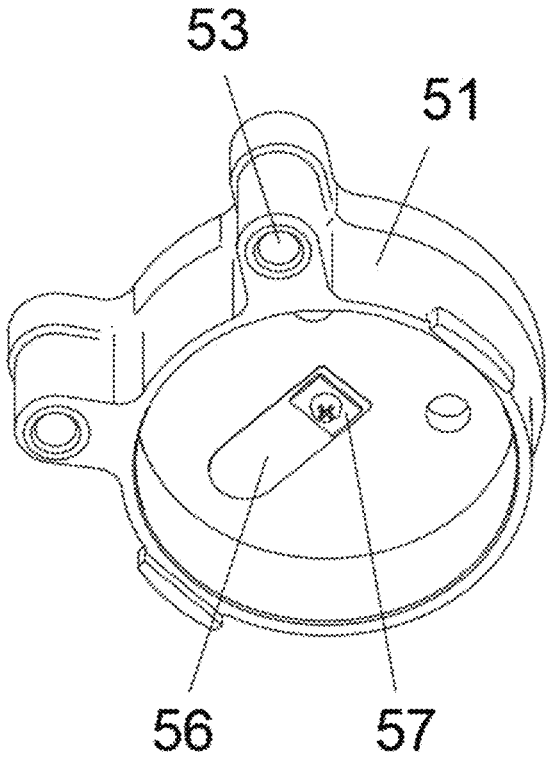
FIG. 11 is a space diagram of a supporting body of the present disclosure.

As shown in FIG. 9 and FIG. 10, the positive pressure air passage structure 4 includes a positive pressure air passage supporting body 41, positive pressure air passage valve chambers 42 are symmetrically formed in an upper surface of the positive pressure air passage supporting body 41, positive pressure compression exhaust passages 43 and positive pressure compression air cylinder connecting air passages 44 which communicate with the positive pressure air passage valve chambers 42 are formed in side surfaces of the positive pressure air passage supporting body 41, the two positive pressure compression exhaust passages 43 are located in the symmetrical side surfaces of the positive pressure air passage supporting body 41, the four positive pressure compression air cylinder connecting air passages 44 are uniformly located in the other side surfaces of the positive pressure air passage supporting body 41, the positive pressure compression exhaust passages 43 are connected with pipe joints, and the positive pressure compression air cylinder connecting air passages 44 communicate with the air cylinders 5.

An air exchange principle of the positive pressure air passage structure 4 is the same as that of the vacuum air passage structure 2.

Figure 12:
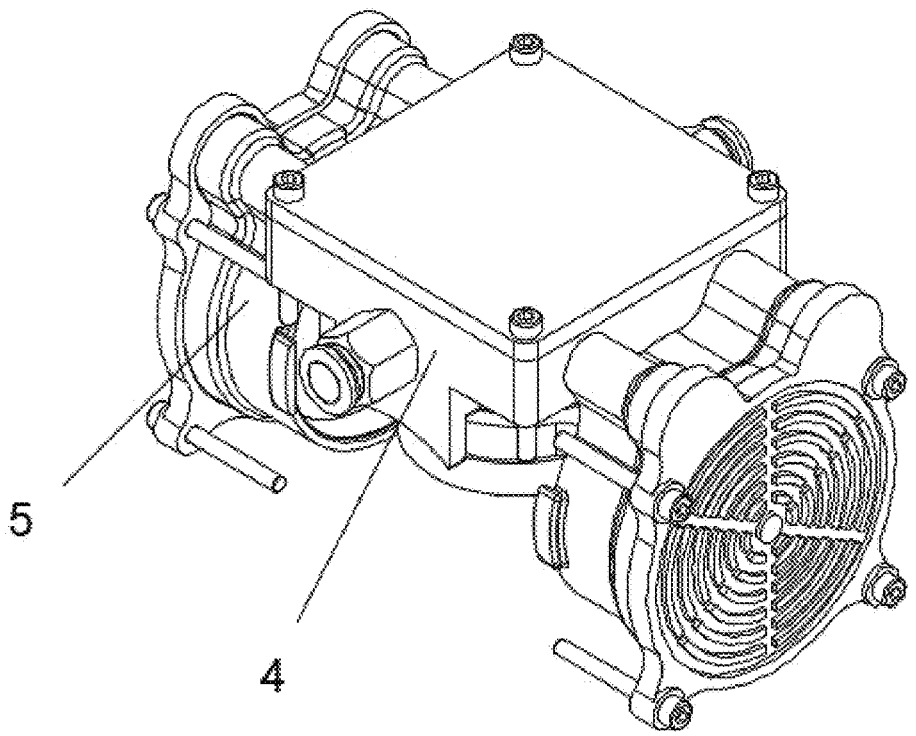
FIG. 12 is a first space diagram of air cylinders of the present disclosure.
Figure 13:
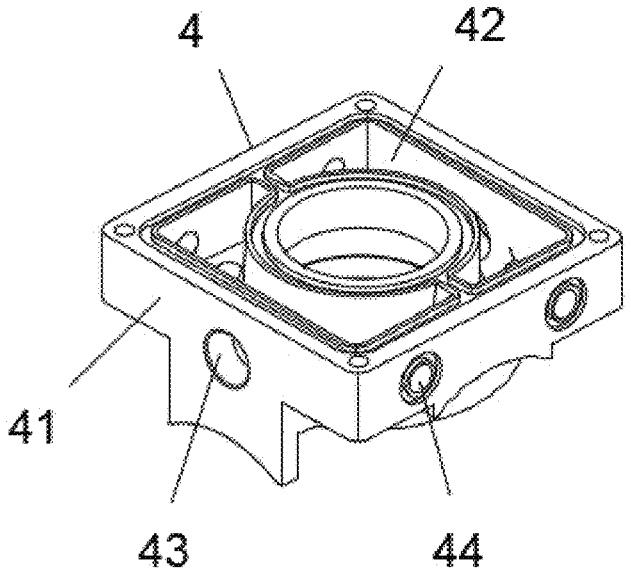
FIG. 13 is a second space diagram of air cylinders of the present disclosure.
Figure 14:
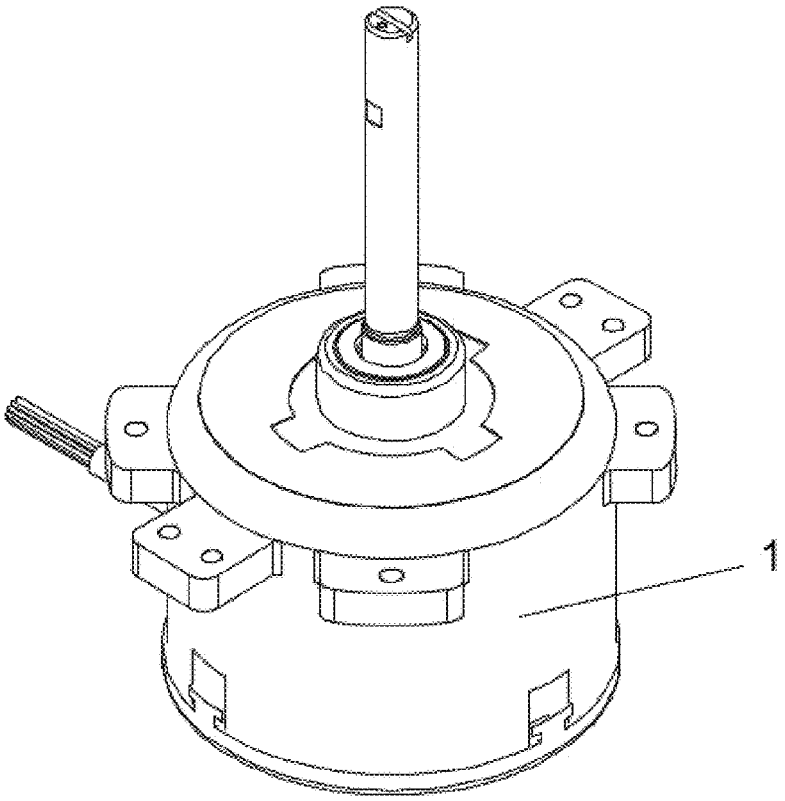
FIG. 14 is a space diagram of a motor of the present disclosure.

Specifically, as shown in FIG. 12 and FIG. 13, each air cylinder 5 includes an air cylinder main body 51 and an air cylinder valve chamber cover 59, wherein the air cylinder valve chamber cover 59 is assembled on an outer surface of the air cylinder main body 51, the air cylinder main body 51 is fixedly mounted on the supporting body 3, air cylinder valve chambers 52 which are arranged symmetrically are formed in the outer surface of the air cylinder main body 51, air exchange holes 53 which communicate with the air cylinder valve chambers 52 are formed in a surface of the air cylinder main body 51, the air exchange holes 53 correspond to the negative pressure vacuum air cylinder connecting air passages 24 or the positive pressure compression air cylinder connecting air passages 44, a compression cavity is formed in an inner surface of the air cylinder main body 51, the piston rod 7 is movably assembled in the compression cavity, vent holes are formed in an inner surface of the compression cavity, and the plurality of vent holes are located in the two air cylinder valve chambers 52 respectively.

Each piston rod 7 is mounted on the output shaft of the motor 1 through the eccentric wheel group 6, with running of the motor 1, the piston rod 7 performs a reciprocating motion in the compression cavity of the air cylinder 5 with the eccentric wheel group 6, and thus a process of negative pressure air entering and compression exhaust is implemented.

A total of four air cylinders 5 are arranged, in a case of keeping a running speed and a total exhaust flow of each piston rod 7, a stroke of each piston rod 7 may be smaller, an oscillation distance of the piston rod 7 is shorter, and thus a sealing characteristic of the leather cups may be guaranteed within a long period of time. Besides, a heat dissipation surface is greatly expanded by arranging the four air cylinders 5, the compressor is effectively cooled, and thus a compression efficiency is improved.

The four air cylinders 5 and the piston rods 7 remain a 90-degree phase difference mutually, force acting on the output shaft of the motor 1 can be balanced, so fluctuation of a running torque is inhibited, the compression efficiency is improved, in addition, air entering and exhaust noise is balanced, and lower noise and smaller vibration are achieved.

Specifically, as shown in FIG. 12 and FIG. 13, each air cylinder 5 further includes a negative pressure valve sheet 54, a negative pressure valve sheet pressing plate 55, a positive pressure valve sheet 56 and a positive pressure valve sheet pressing plate 57, wherein the negative pressure valve sheet 54 is fixedly mounted on an inner surface of the air cylinder valve chamber 52 through the negative pressure valve sheet pressing plate 55, the positive pressure valve sheet 56 is fixedly mounted on the inner surface of the compression cavity through the positive pressure valve sheet pressing plate 57, the negative pressure valve sheet 54 and the positive pressure valve sheet 56 block the vent holes in the different air cylinder valve chambers 52, a shape of the negative pressure valve sheet pressing plate 55 is the same as a shape of the negative pressure valve sheet 54, and an outer end of the negative pressure valve sheet pressing plate 55 is lifted in an arc towards an outer side.

The air circulation direction is controlled through the negative pressure valve sheets 54 and the positive pressure valve sheets 56.

The outer end of the negative pressure valve sheet pressing plate 55 is lifted in an arc to limit an opening angle of the negative pressure valve sheet 54 during running, so as to reduce damage to the negative pressure valve sheet 54 due to rapid and frequent opening, and prolong a service life of the compressor.

Figure 3:
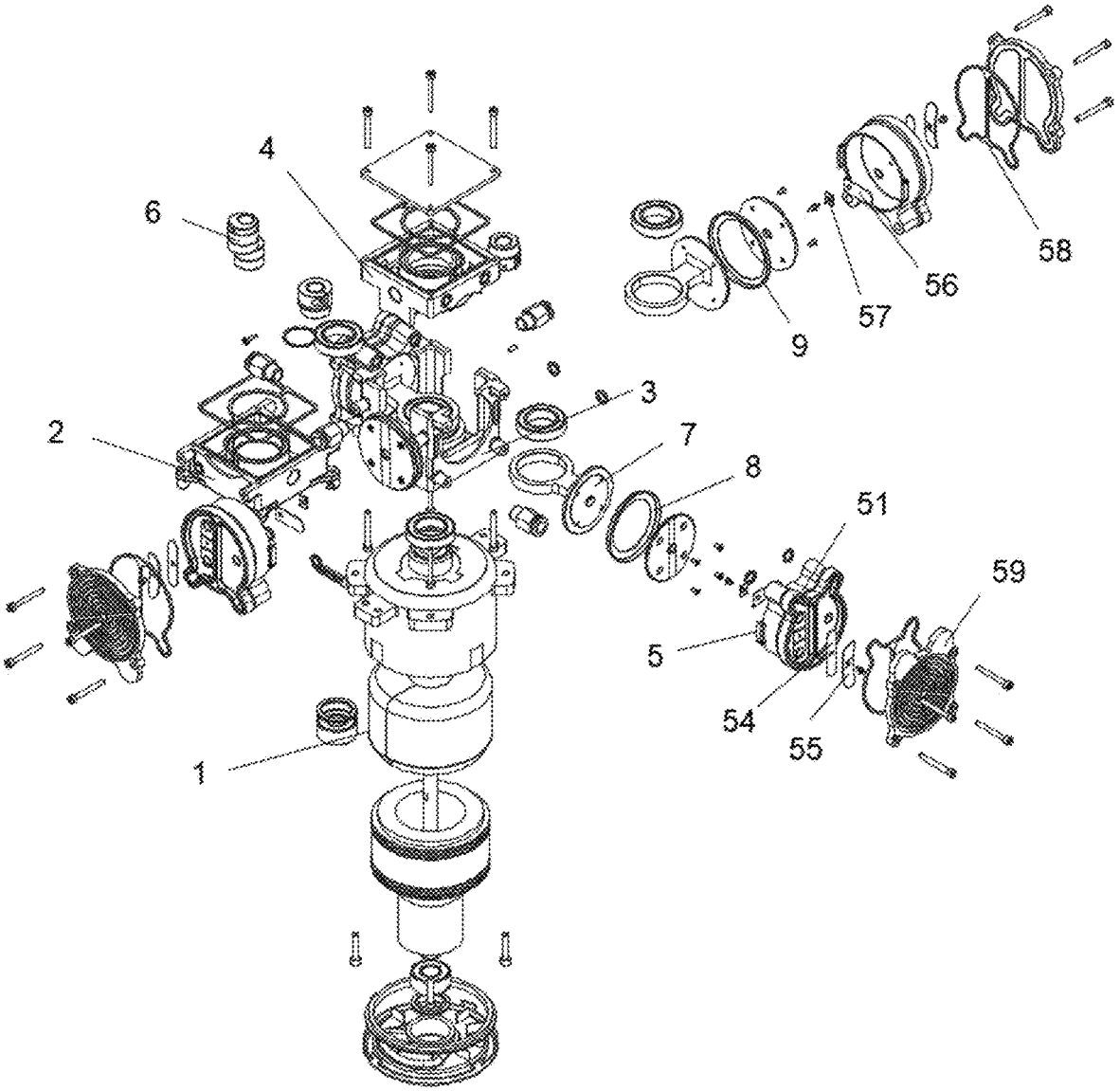
FIG. 3 is an explosive view of the present disclosure.
Figure 4:
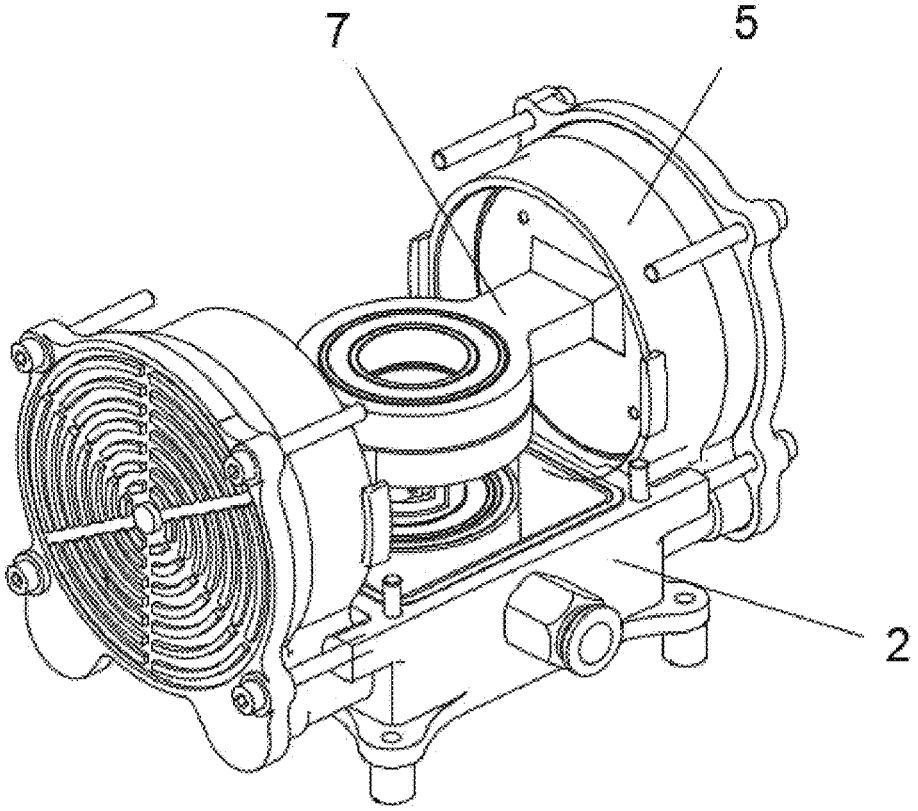
FIG. 4 is a space diagram of a vacuum air passage structure and air cylinders in cooperation in the present disclosure.

It may be known according to FIG. 3 that a protrusion is arranged in a mounting position of the negative pressure valve sheet 54 in the air cylinder valve chamber 52, an opening auxiliary groove is formed in the protrusion, and thus the negative pressure valve sheet 54 cannot be completely attached to the protrusion and can be opened smoothly.

Specifically, as shown in FIG. 12, an air cylinder seal ring mounting groove is formed in an outer surface of the air cylinder main body 51, and an air cylinder seal ring 58 is assembled in the air cylinder seal ring mounting groove.

Sealing of the air cylinder valve chamber 52 is implemented by cooperation of the air cylinder seal ring 58 and the air cylinder valve chamber cover 59.

Specifically, the air cylinder main body 51 and the leather cups are made of a polytetrafluoroethylene material, and a self-lubricating coating is arranged on an inner wall of the compression cavity of the air cylinder main body 51.

For the same type of compressor on the market, an air cylinder usually adopts a hard anodized coating for improving wear resistance and smoothness of an interior of the air cylinder, but this method improves the smoothness of an inner wall of the air cylinder, resulting in that a self-lubricating effect between two contact parts with leather cups of dynamic sealing components made of a flexible polytetrafluoroethylene material cannot be formed, the leather cups, though having a self-lubricating function, will be worn greatly due to long-time running, thus failure of dynamic sealing is caused, and the service life of the compressor is shortened during oil-free lubricating.

The air cylinder main body 51 is made of the polytetrafluoroethylene material same as the leather cups, a layer of self-lubricating coating with a 0.05-0.08 micrometer thickness is formed on the inner wall of the air cylinder main body 51 through a micro-arc oxidation process, thus the inner wall of the air cylinder main body 51 has the same self-lubricating effect as the leather cups, and the service life of the compressor can be effectively prolonged.

Figure 2:
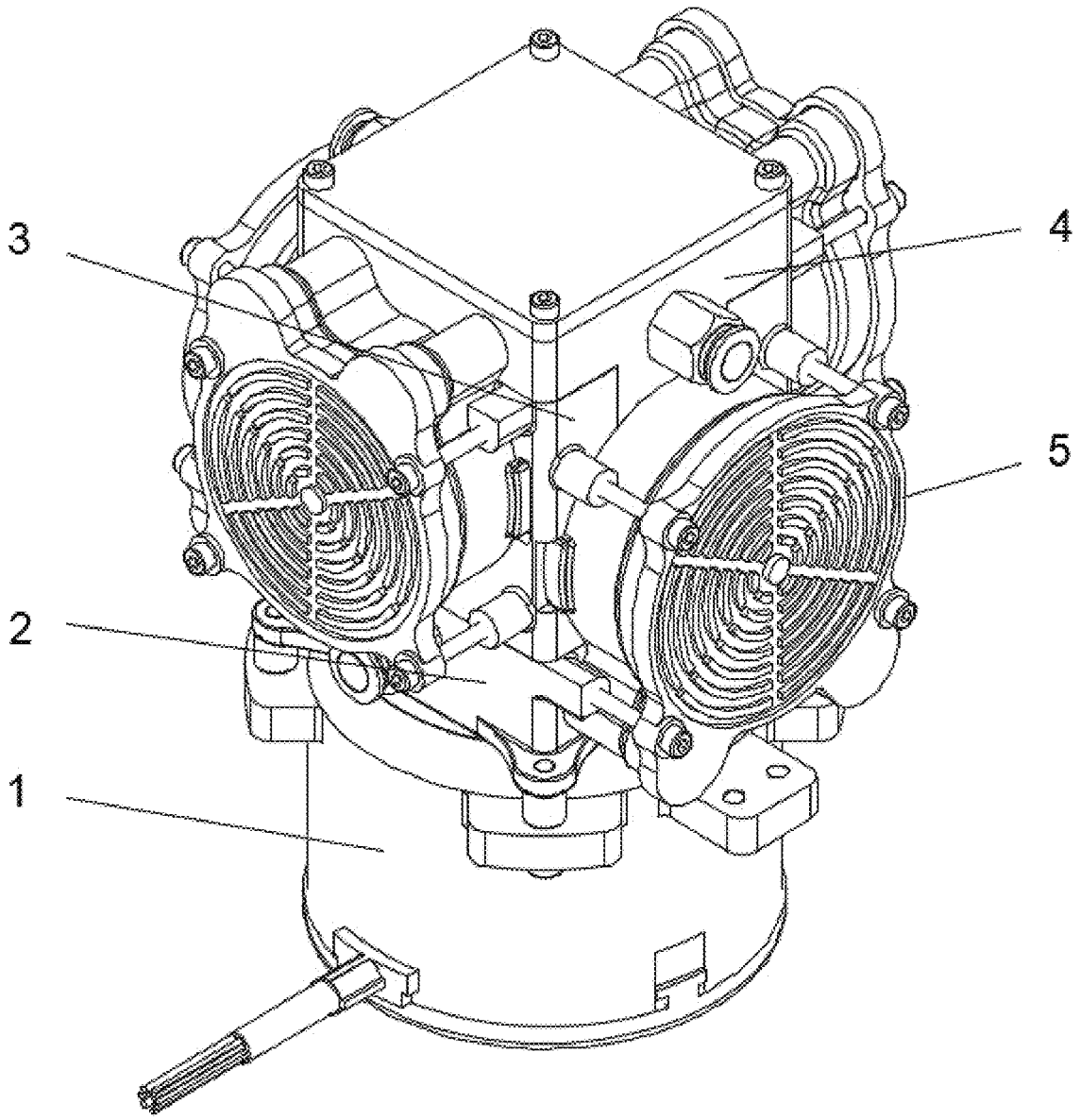
FIG. 2 is a second space diagram of the present disclosure.

Specifically, as shown in FIG. 1 to FIG. 3, a net-shaped heat dissipation structure is arranged on an outer surface of each air cylinder valve chamber cover 59 and can cool the air cylinder 5 of the compressor effectively, so effective running of the compressor is ensured.

Specifically, the leather cups include a positive pressure end leather cup 8 and a vacuum end leather cup 9, an opening of the positive pressure end leather cup 8 faces an outer side, and an opening of the vacuum end leather cup 9 faces an inner side.

The positive pressure end leather cup 8 is mounted on the piston rod 7 arranged in the positive pressure compression air cylinder, the vacuum end leather cup 9 is mounted on the piston rod 7 arranged in the negative pressure vacuum air cylinder, and the opening of the positive pressure end leather cup 8 faces outwards so as to perform a better compression work.

Figure 5:
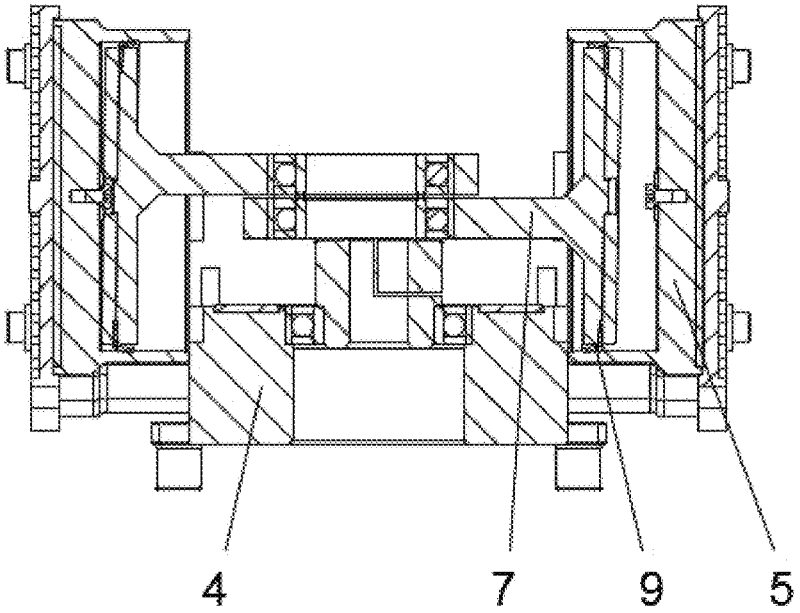
FIG. 5 is a front sectional view of FIG. 4 in the present disclosure.
Figure 6:
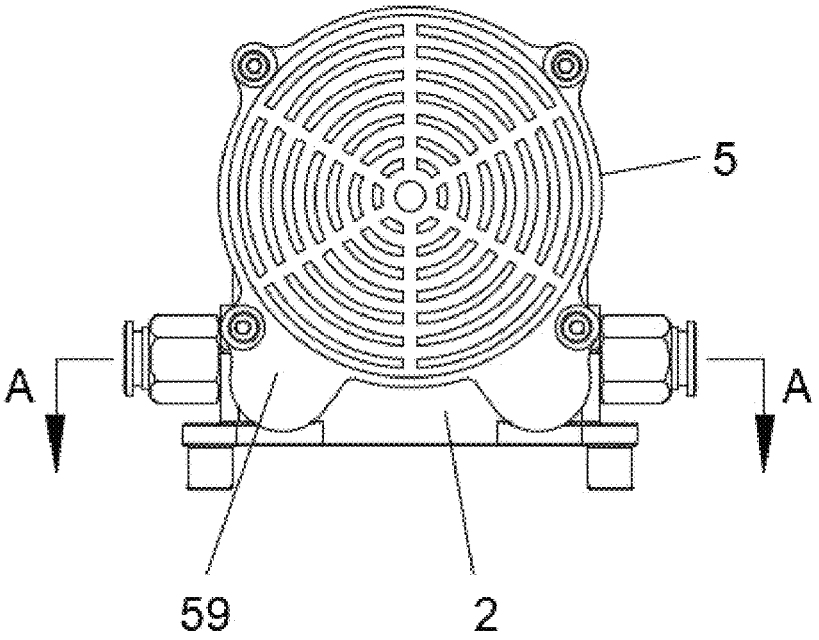
FIG. 6 is a left view of FIG. 4 in the present disclosure.
Figure 7:
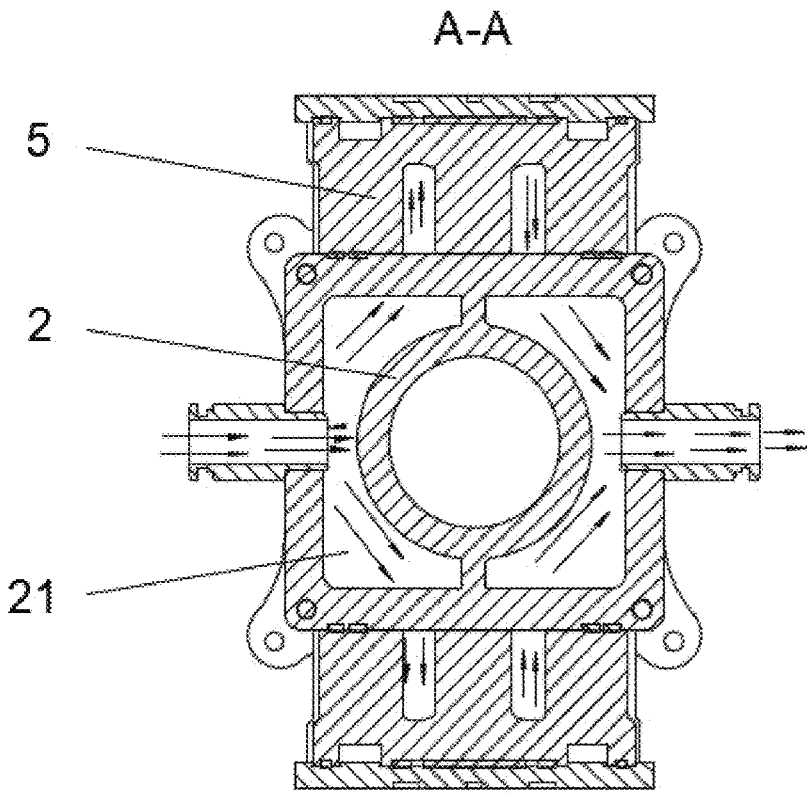
FIG. 7 is a sectional view in an A-A direction in FIG. 6 in the present disclosure.
Figure 8:
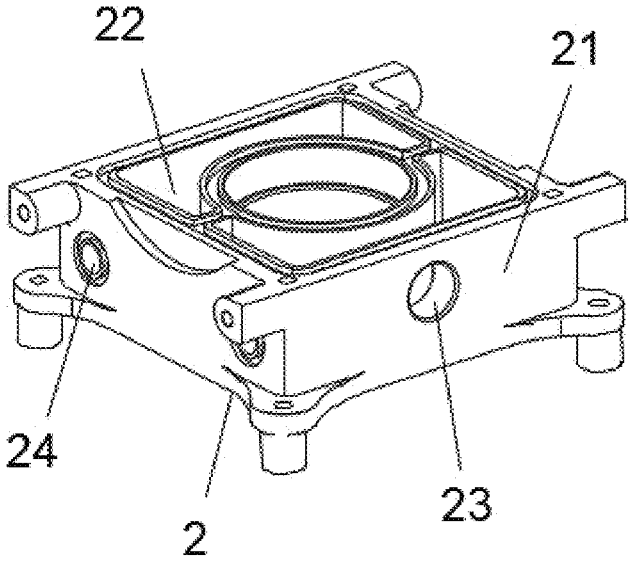
FIG. 8 is a space diagram of a vacuum air passage structure of the present disclosure.
Figure 17:
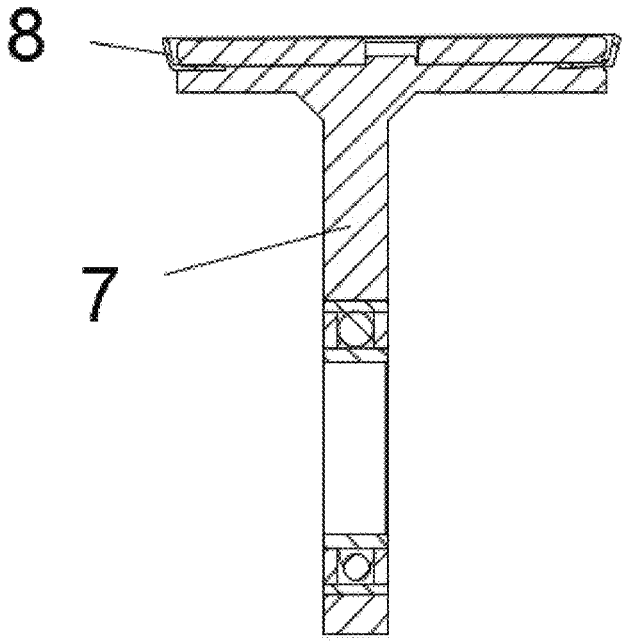
FIG. 17 is a sectional view of a piston rod of the present disclosure.

Specifically, as shown in FIG. 5 and FIG. 17, inclination angle supplement structures are arranged on the outer end faces of the piston rods 7 and on outer end faces of the leather cup pressing plates.

The inclination angle supplement structures are on the outer end faces of the piston rods 7 and on the outer end faces of the leather cup pressing plates, namely, the outer end faces of the piston rods 7 and the outer end faces of the leather cup pressing plates are inclined, and the inclination angle is 0.85° to 1.25°, which is adjusted according to actual factors such as a stroke length of each piston rod 7.

Each piston rod 7, when moving in the air cylinder 5, may move in an 8-shaped running route which is commonly known as a swinging piston, in a process of a piston stroke from a point 0 to a vertex, the inclination angle of running may occur due to a structure limitation to form a dead angle with the inner wall of the air cylinder and may cause loss to the compression ratio, meanwhile, non-uniform and excessive wear may occur to the leather cups of the dynamic sealing components due to this included angle, consequently, the service life is shortened, an allowance gap of the compressor piston group and the inner surface of the air cylinder is increased by the included angle, and effective compression cannot be achieved.

For solving the above problem, the inclination angles are added to the piston rods 7 and the leather cup pressing plates, so the piston rods 7 remain the rectangular compression state with the inner surfaces of the air cylinders to the maximum degree during the stroke process, and the compression ratio is ensured.

By the design for each piston rod 7, when the piston rod 7 is located at the point 0 or the vertex during the running process, the outer end faces of the four piston rods 7 are substantially parallel to the inner surfaces of the corresponding air cylinders 5, which may reduce the dead angles of the ends of the piston rods 7 and the interiors of the air cylinder5, so that the compression efficiency can be improved.

Specifically, as shown in FIG. 3, sealing element mounting grooves are formed in the upper surface of the vacuum air passage supporting body 21 and the upper surface of the positive pressure air passage supporting body 41, planar sealing elements are assembled in the sealing element mounting grooves, and a top cover is fixedly mounted on the upper surface of the positive pressure air passage supporting body 41, so that sealing performance of the vacuum air passage structure 2 and the positive pressure air passage structure 4 is further guaranteed.

Figure 15:
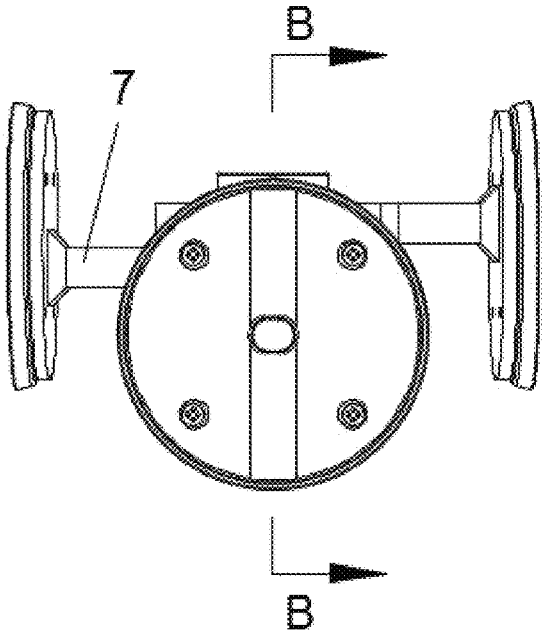
FIG. 15 is a front view of an eccentric wheel group and piston rods in cooperation in the present disclosure.
Figure 16:
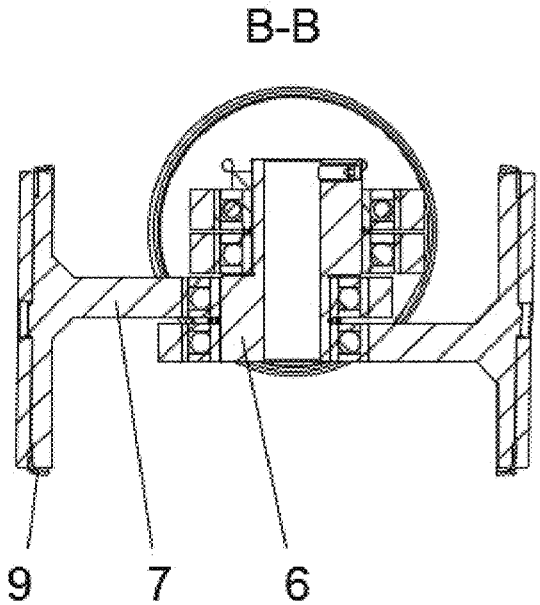
FIG. 16 is a sectional view in a B-B direction in FIG. 15 in the present disclosure.

Specifically, as shown in FIG. 15 and FIG. 16, the eccentric wheel group 6 is formed by combining two eccentric wheels which are integrally formed, deflection angles of the two eccentric wheels relative to the output shaft of the motor 1 are different, and two piston rods 7 are symmetrically assembled on an outer wall of each eccentric wheel.

The two piston rods 7 connected with the eccentric wheel on an upper side are arranged in the positive pressure compression air cylinder, and the two piston rods 7 connected with the eccentric wheel on a lower side are arranged in the negative pressure vacuum air cylinder. It may be known according to FIG. 3 and FIG. 16 that a position relationship of the two eccentric wheels can guarantee that the two positive pressure compression air cylinders and the two negative pressure vacuum air cylinders alternately perform works of air entering and air compressing, namely, at the same moment, one positive pressure compression air cylinder performs the work of air entering and the other positive pressure compression air cylinder performs the work of compressing and exhaust, and one negative pressure vacuum air cylinder performs the work of air entering and the other negative pressure vacuum air cylinder performs the work of compressing and exhaust.

The above content is only preferred embodiments of the present disclosure, those ordinarily skilled in the art may make many changes to specific implementations and application scope according to the concept of the present disclosure, and these changes fall within the protection scope of the present disclosure as long as these changes do not depart from the concept of the present disclosure.

The invention claimed is:

1. A full-sealing positive pressure and negative pressure integrated oil-free compressor for oxygen generation, comprising a motor, a vacuum air passage structure, a supporting body, a positive pressure air passage structure and air cylinders, wherein the vacuum air passage structure, the supporting body and the positive pressure air passage structure are fixedly mounted on an upper surface of the motor in sequence, the positive pressure air passage structure does not communicate with the supporting body, no air passage is arranged on a surface of the supporting body, the air cylinders comprise two negative pressure vacuum air cylinders and two positive pressure compression air cylinders, the negative pressure vacuum air cylinders and the positive pressure compression air cylinders are fixedly mounted on four side surfaces of the supporting body in an alternating mode, the two negative pressure vacuum air cylinders communicate with the vacuum air passage structure, the two positive pressure compression air cylinders communicate with the positive pressure air passage structure, an eccentric wheel group is assembled on an output shaft of the motor, piston rods are assembled on an outer surface of the eccentric wheel group, the four piston rods are assembled in the corresponding air cylinders respectively, leather cup pressing plates are fixedly mounted on outer end faces of the piston rods, and leather cups are assembled at outer ends of the piston rods through the leather cup pressing plates;

the vacuum air passage structure comprises a vacuum air passage supporting body, vacuum air passage valve chambers are symmetrically formed in an upper surface of the vacuum air passage supporting body, two negative pressure suction and exhaust passages and four negative pressure vacuum air cylinder connecting air passages which communicate with the vacuum air passage valve chambers are formed in side surfaces of the vacuum air passage supporting body, the two negative pressure suction and exhaust passages are located in the symmetrical side surfaces of the vacuum air passage supporting body, the four negative pressure vacuum air cylinder connecting air passages are uniformly located in the other side surfaces of the vacuum air passage supporting body, the negative pressure suction and exhaust passages are connected with pipe joints, and the negative pressure vacuum air cylinder connecting air passages communicate with the negative pressure vacuum air cylinders;

the positive pressure air passage structure comprises a positive pressure air passage supporting body, positive pressure air passage valve chambers are symmetrically formed in an upper surface of the positive pressure air passage supporting body, two positive pressure compression exhaust passages and four positive pressure compression air cylinder connecting air passages which communicate with the positive pressure air passage valve chambers are formed in side surfaces of the positive pressure air passage supporting body, the two positive pressure compression exhaust passages are located in the symmetrical side surfaces of the positive pressure air passage supporting body, the four positive pressure compression air cylinder connecting air passages are uniformly located in the other side surfaces of the positive pressure air passage supporting body, the positive pressure compression exhaust passages are connected with pipe joints, and the positive pressure compression air cylinder connecting air passages communicate with the compression air cylinder connecting air passages communicate with the positive pressure compression air cylinders air cylinders;

each air cylinder comprises an air cylinder main body and an air cylinder valve chamber cover, wherein the air cylinder valve chamber cover is assembled on an outer surface of the air cylinder main body, the air cylinder main body is fixedly mounted on the supporting body, two air cylinder valve chambers which are arranged symmetrically are formed in the outer surface of the air cylinder main body, air exchange holes which communicate with the two air cylinder valve chambers are formed in a surface of the air cylinder main body, the air exchange holes correspond to the negative pressure vacuum air cylinder connecting air passages or the positive pressure compression air cylinder connecting air passages, a compression cavity is formed in an inner surface of the air cylinder main body, the piston rod is movably assembled in the compression cavity, a plurality of vent holes are formed in an inner surface of the compression cavity, and the plurality of vent holes are located in the two air cylinder valve chambers respectively; and each air cylinder further comprises a negative pressure valve sheet, a negative pressure valve sheet pressing plate, a positive pressure valve sheet and a positive pressure valve sheet pressing plate, wherein the negative pressure valve sheet is fixedly mounted on an inner surface of the air cylinder valve chamber through the negative pressure valve sheet pressing plate, the positive pressure valve sheet is fixedly mounted on the inner surface of the compression cavity through the positive pressure valve sheet pressing plate, the negative pressure valve sheet and the positive pressure valve sheet block the vent holes in the different air cylinder valve chambers, a shape of the negative pressure valve sheet pressing plate is the same as a shape of the negative pressure valve sheet, and an outer end of the negative pressure valve sheet pressing plate is lifted in an arc towards an outer side.

2. The full-sealing positive pressure and negative pressure integrated oil-free compressor for oxygen generation according to claim 1, wherein an air cylinder seal ring mounting groove is formed in an outer surface of the air cylinder main body, and an air cylinder seal ring is assembled in the air cylinder seal ring mounting groove.

3. The full-sealing positive pressure and negative pressure integrated oil-free compressor for oxygen generation according to claim 1, wherein the air cylinder main body and the leather cups are made of a polytetrafluoroethylene material, and a self-lubricating coating is arranged on an inner wall of the compression cavity of the air cylinder main body.

4. The full-sealing positive pressure and negative pressure integrated oil-free compressor for oxygen generation according to claim 1, wherein a net-shaped heat dissipation structure is arranged on an outer surface of each air cylinder valve chamber cover.

5. The full-sealing positive pressure and negative pressure integrated oil-free compressor for oxygen generation according to claim 1, wherein the leather cups comprise a positive pressure end leather cup and a vacuum end leather cup, an opening of the positive pressure end leather cup faces an outer side, and an opening of the vacuum end leather cup faces an inner side.

6. The full-sealing positive pressure and negative pressure integrated oil-free compressor for oxygen generation according to claim 1, wherein inclination angle supplement structures are arranged on the outer end faces of the piston rods and outer end faces of the leather cup pressing plates.

7. The full-sealing positive pressure and negative pressure integrated oil-free compressor for oxygen generation according to claim 1, wherein sealing element mounting grooves are formed in the upper surface of the vacuum air passage supporting body and the upper surface of the positive pressure air passage supporting body, planar sealing elements are assembled in the sealing element mounting grooves, and a top cover is fixedly mounted on the upper surface of the positive pressure air passage supporting body.

8. The full-sealing positive pressure and negative pressure integrated oil-free compressor for oxygen generation according to claim 1, wherein the eccentric wheel group is formed by combining two eccentric wheels which are integrally formed, deflection angles of the two eccentric wheels relative to the output shaft of the motor are different, and two piston rods are symmetrically assembled on an outer wall of each eccentric wheel.

* * * * *